US006477878B2

(12) United States Patent
Bisaillon et al.

(10) Patent No.: US 6,477,878 B2
(45) Date of Patent: Nov. 12, 2002

(54) MACHINE FOR PRODUCING CORRUGATED WHEEL SPACERS

(75) Inventors: Gerard Bisaillon, Magog (CA); Rolland Bisaillon, Racine (CA)

(73) Assignee: Les Aciers Robond Inc., Magog (CA)

( * ) Notice: Subject to any disclaimer, the term of this patent is extended or adjusted under 35 U.S.C. 154(b) by 0 days.

(21) Appl. No.: 09/789,839

(22) Filed: Feb. 22, 2001

(65) Prior Publication Data

US 2002/0112519 A1 Aug. 22, 2002

(51) Int. Cl.[7] ..... B21D 15/04
(52) U.S. Cl. ..... 72/105; 72/106
(58) Field of Search ..... 72/102, 105, 106, 72/110

(56) References Cited

U.S. PATENT DOCUMENTS 3,407,638 A * 10/1968 Greis et al. ..... 72/105
4,454,739 A * 6/1984 Ciccorelli ..... 72/106
4,869,088 A * 9/1989 Kadotani ..... 72/106
4,888,972 A * 12/1989 Rouse ..... 72/186
5,584,202 A * 12/1996 Kanamaru et al. ..... 72/105

FOREIGN PATENT DOCUMENTS

JP 57-56131 * 4/1982 ..... 72/105
JP 59-225838 * 12/1984 ..... 72/106
JP 62-282735 * 12/1987 ..... 72/105

* cited by examiner

*Primary Examiner*—Ed Tolan
(74) *Attorney, Agent, or Firm*—George A. Seaby

(57) ABSTRACT

A machine for producing a corrugated wheel spacer for use between tandem truck wheels includes top and bottom corrugated rollers which are driven in synchronism with an annular spacer blank therebetween to corrugate the blank. The top roller is suspended from a carriage for vertical movement towards and away from the bottom roller so that an annular blank can be placed on the bottom roller when the rollers are spaced apart and the rollers can be moved together to effect a corrugating operation.

9 Claims, 11 Drawing Sheets

MACHINE FOR PRODUCING CORRUGATED WHEEL SPACERS

BACKGROUND OF THE INVENTION

1. Field of the Invention

This invention relates to a machine for producing corrugated truck wheel spacers.

2. Discussion of the Prior Art

Cylindrical or annular wheel spacers have long been used with spoked dual wheel assemblies. One such spacer is disclosed by Canadian Design Registration No. 68,541, issued to Aciers Robond Inc. on May 14, 1991. Another type of wheel spacer is defined by blocks, defining small sections of a circle. Examples of block type wheel spacers are disclosed by U.S. Pat. No. 2,280,746, issued to F. W. Burger on Apr. 21, 1942; U.S. Pat. No. 3,837,709, issued to R. K. Williamson on Sep. 24, 1974 and U.S. Pat. No. 4,902,074, issued to R. A. DeRegnaucourt et al on Feb. 20, 1990. More recently annular, corrugated wheel spacers have been adopted. Corrugated wheel spacers provide support around the entire periphery of a wheel rim, and are significantly stronger than a planar spacer of the type disclosed by the above referenced design registration. However, the production of such corrugated spacers can be difficult and/or time consuming.

GENERAL DESCRIPTION OF THE INVENTION

The object of the present invention is to provide a simple apparatus for quickly and efficiently producing a corrugated wheel spacer.

Accordingly, the invention relates to a machine for producing a corrugated wheel spacer comprising:

(a) a frame;

(b) a first corrugated roller mounted on said frame for receiving an annular spacer blank;

(c) a second corrugated roller mounted on said frame in opposition to said first roller, said second roller being movable between a first position spaced apart from said first roller permitting mounting of a spacer blank on the first roller, and a second position proximate the first roller in which the spacer blank is sandwiched between the first and second rollers.

(d) teeth on each said first and second roller for meshing during rotation of said rollers to form corrugations on a spacer blank sandwiched therebetween; and (e) a drive for simultaneously rotating said first and second rollers, whereby corrugations are formed in a spacer blank located therebetween.

BRIEF DESCRIPTION OF THE DRAWINGS

The invention is described hereinafter in greater detail with reference to the accompanying drawings, which illustrate a preferred embodiment of the invention, and wherein.

DESCRIPTION OF THE PREFERRED EMBODIMENT

Figure 2:
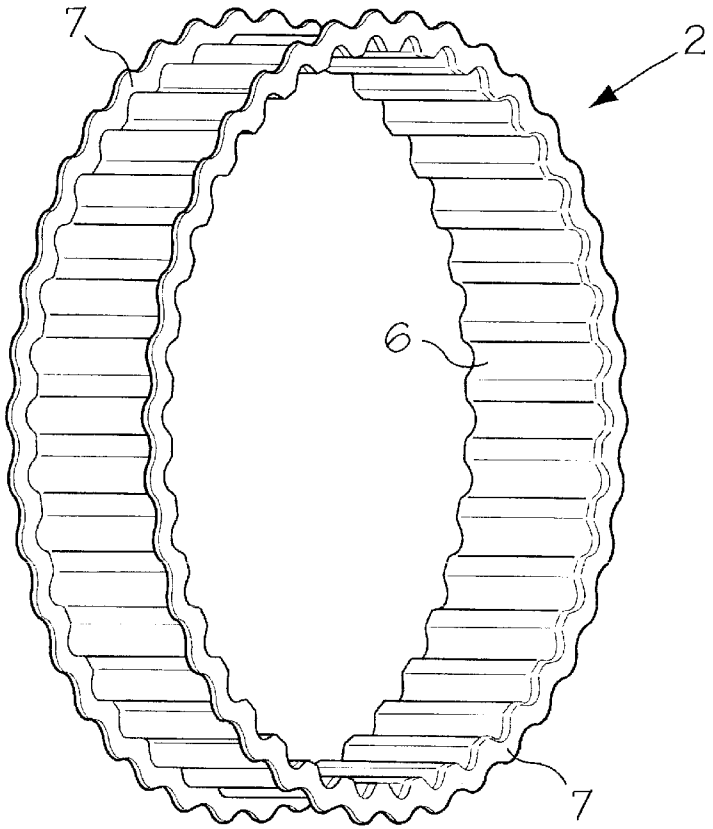
FIG. 2 is a perspective view of a corrugated wheel spacer produced using the apparatus of the present invention.
Figure 1:
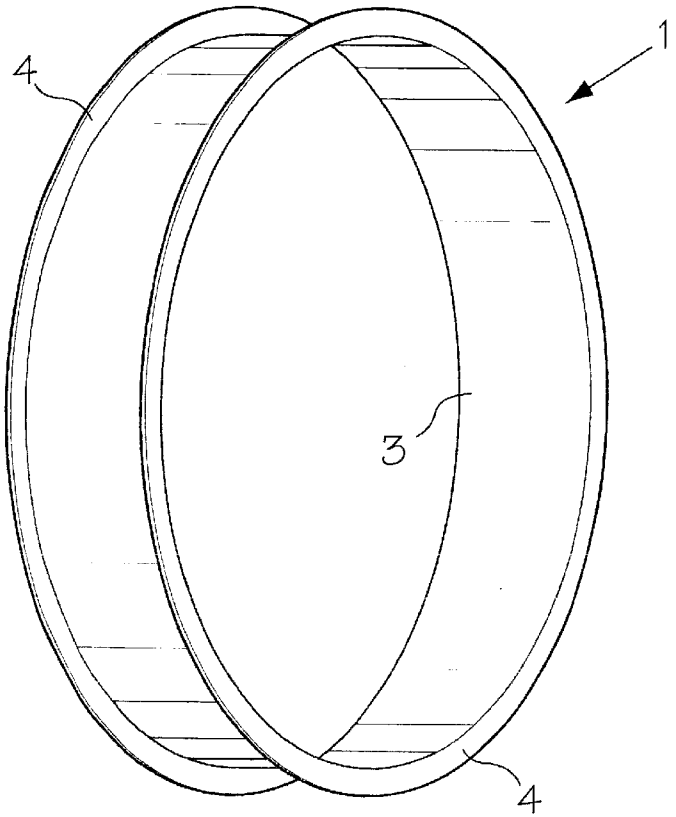
FIG. 1 is a perspective view of a blank used to form a corrugated wheel spacer.

Referring to FIGS. 1 and 2, the machine of the present invention is designed to shape an annular blank generally indicated at 1 to form a corrugated wheel spacer generally indicated at 2. The blank 1 is defined by a cylindrical steel body 3 with a radially extending, annular flange 4 around the periphery of each side thereof. By the same token, the spacer 2 includes a corrugated cylindrical body 6 with radially extending, annular corrugated flanges 7 at each end thereof.

Figure 3:
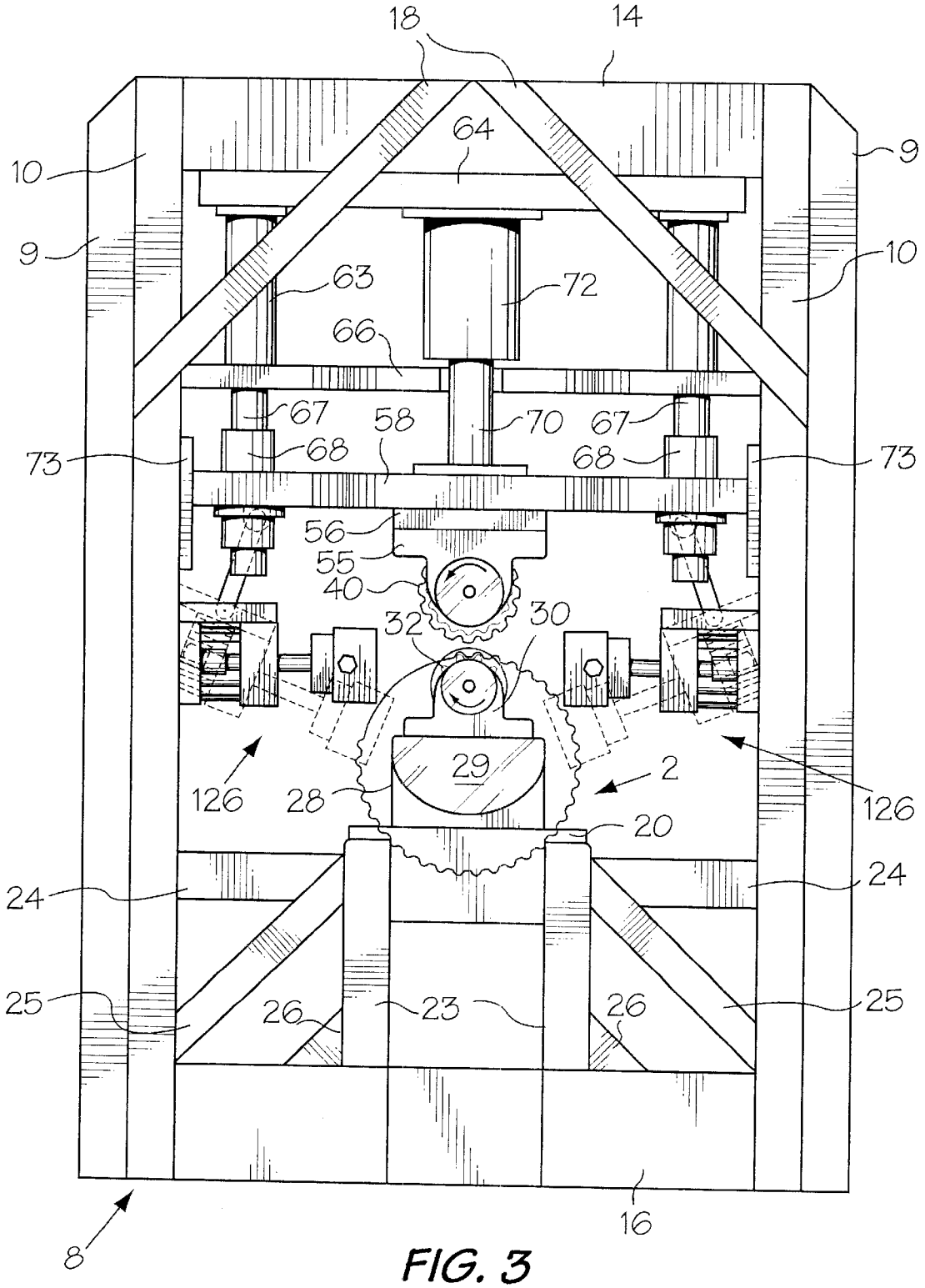
FIG. 3 is a front view of a machine for producing the corrugated spacer of FIG. 2.
Figure 4:
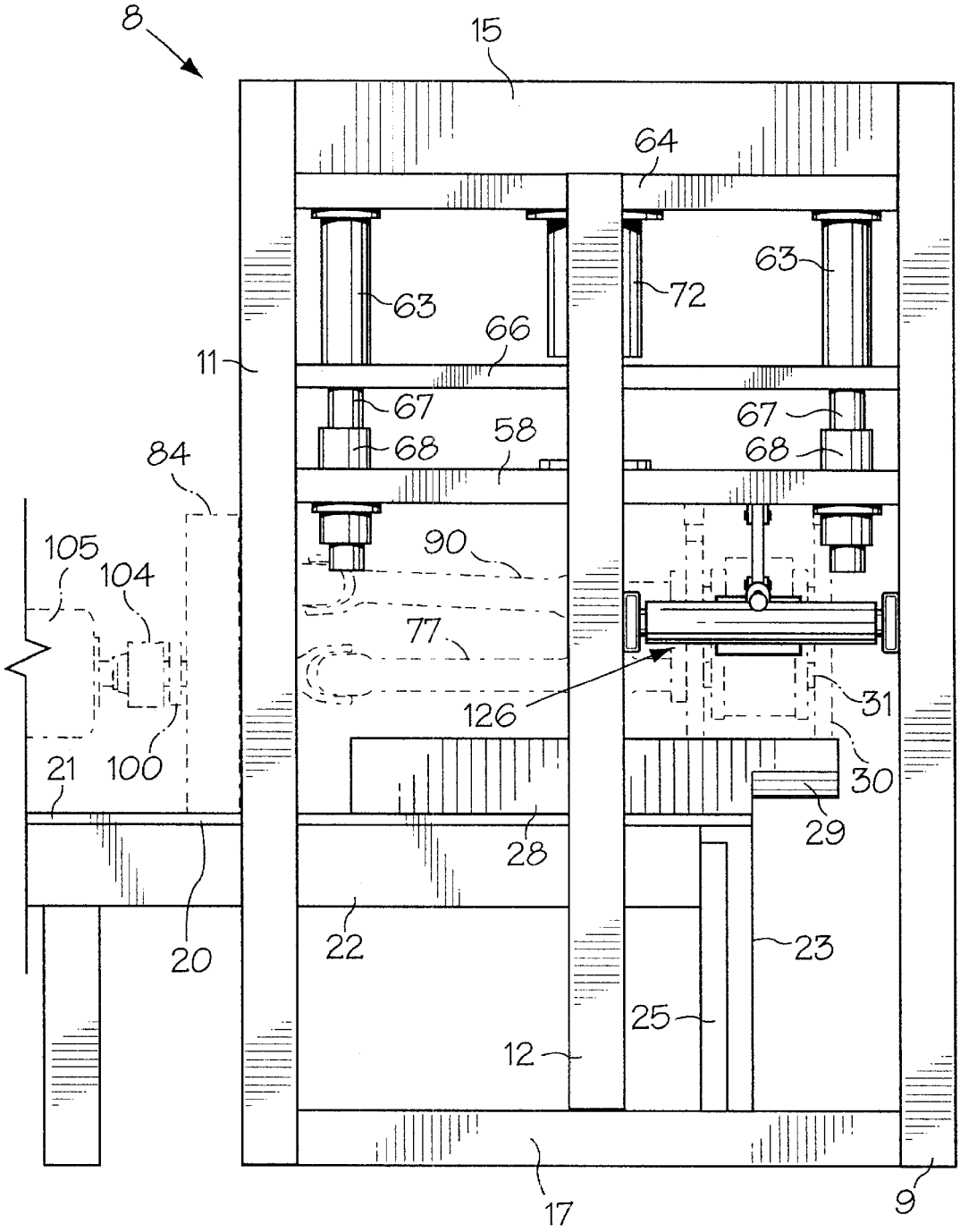
FIG. 4 is a side view of the machine of FIG. 3 with parts omitted.

With reference to FIGS. 3 and 4, the corrugating machine includes a skeletal frame generally indicated at 8 defined by corner posts 9, 10 and 11, central posts 12 (one shown), top bars 14 and 15 interconnecting the upper ends of the posts 9, 10 and 11, bottom bars 16 and 17 interconnecting the lower ends of the posts 9, 10 and 11 and diagonal top braces 18. It will be appreciated that various crossbars (not shown) extend between the rear posts 11 and between the top bars 14 and 15, and bottom bars 16 and 17 for strengthening the frame 8. It is merely necessary that the frame 8 be strong enough to support the remaining elements of the machine. The various posts and bars are formed of square cross section, steel tubing. For strength purposes, two corner posts 9 and 10 are welded together at the front end of the machine where spacer corrugation occurs.

A table 20 is mounted in the frame 8. The table 20 includes a top plate 21 supported by a rectangular frame 22 and a plurality of legs 23. Cross braces 24, diagonal braces 25 and gussets 26 secure the table 20 in the frame 8. The table 20 carries a bed 28 defined by a stainless steel block with a semicylindrical front end 29. Pillow block bearings 30 on the bed 28 support a shaft 31 (FIGS. 4 and 10) carrying a corrugated bottom roller 32.

Figure 5:
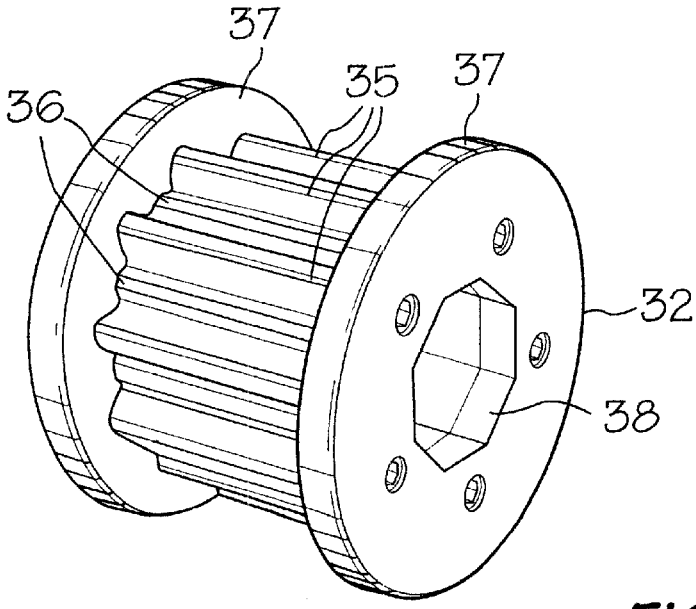
FIG. 5 is a perspective view of a bottom roller used in the machine of FIGS. 3 and 4.
Figure 7:
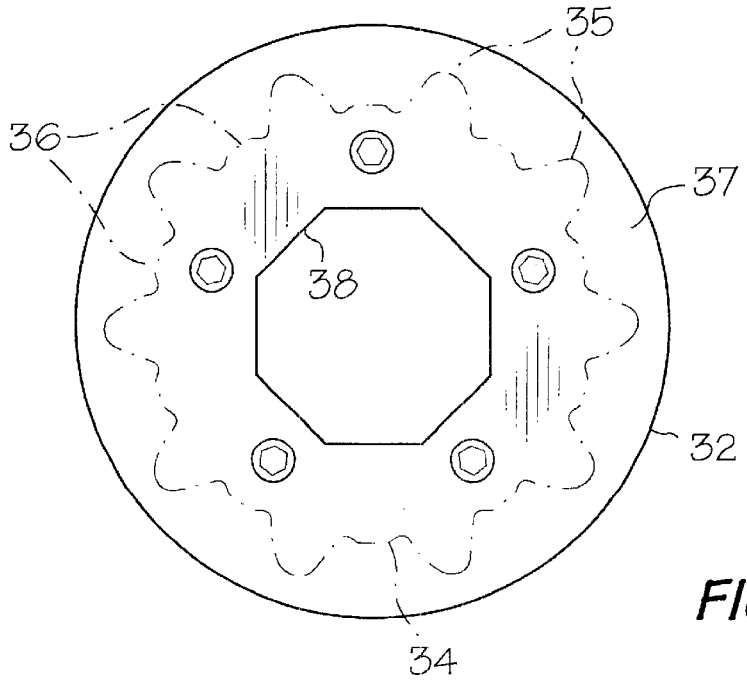
FIG. 7 is an end view of the bottom roller of FIG. 5.
Figure 9:
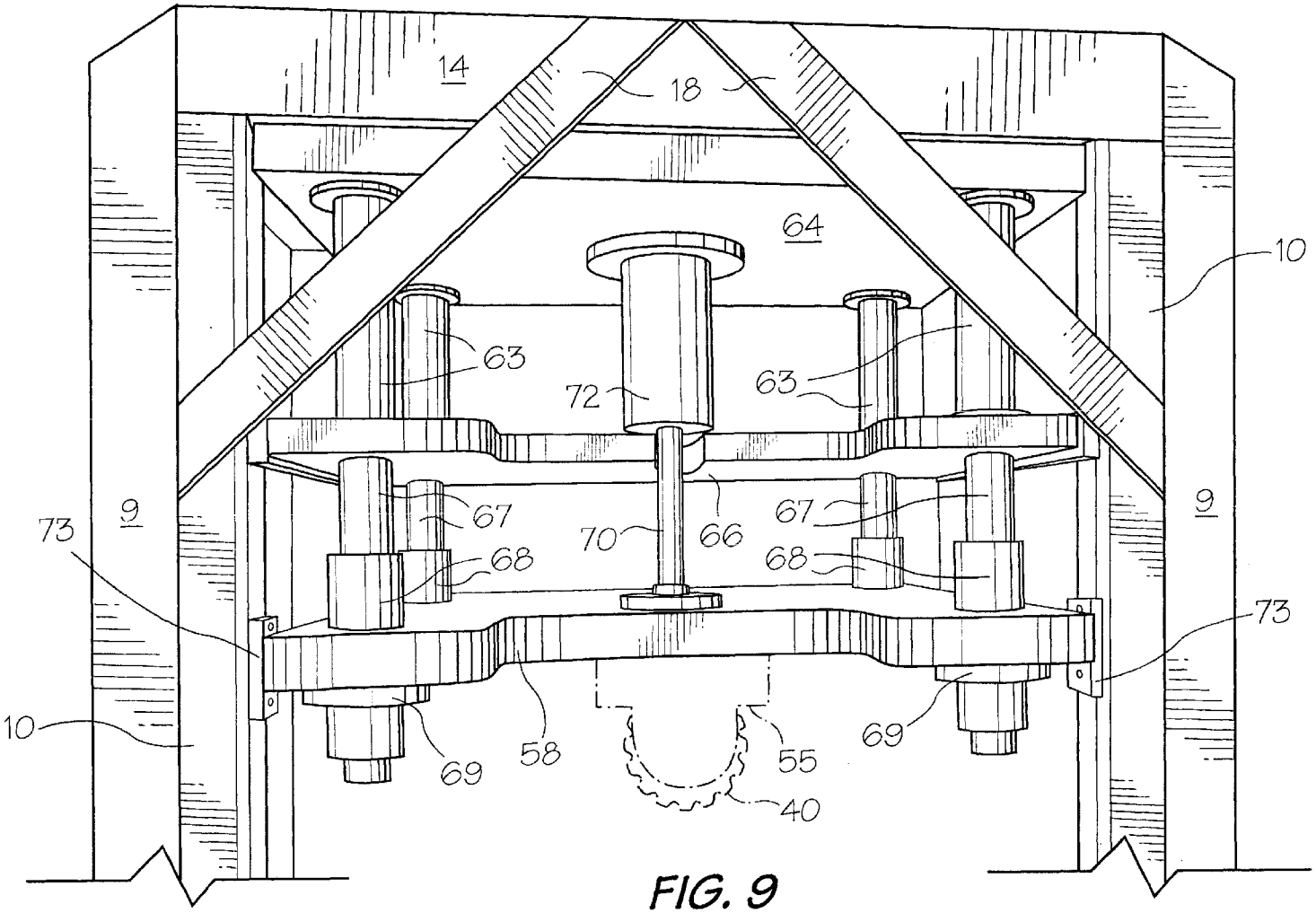
FIG. 9 is a perspective view of an upper portion of the machine of FIGS. 3 and 4.

As best shown in FIGS. 5 and 7, the bottom roller 32 includes a corrugated, generally cylindrical body 34, i.e. an elongated cylindrical body with alternating, longitudinally extending ridges 35 and grooves 36 thereon. A pair of annular flanges 37 on the ends of the body 34 retain a blank 1 or corrugated spacer 2 on the bottom roller. A longitudinally extending central bore 38 receives the shaft 31 for rotating the roller 32. The portion of the shaft 31 passing through the roller 32 and the bore 38 have an octagonal cross section, preventing rotation of the roller 32 relative to the shaft 31.

Figure 6:
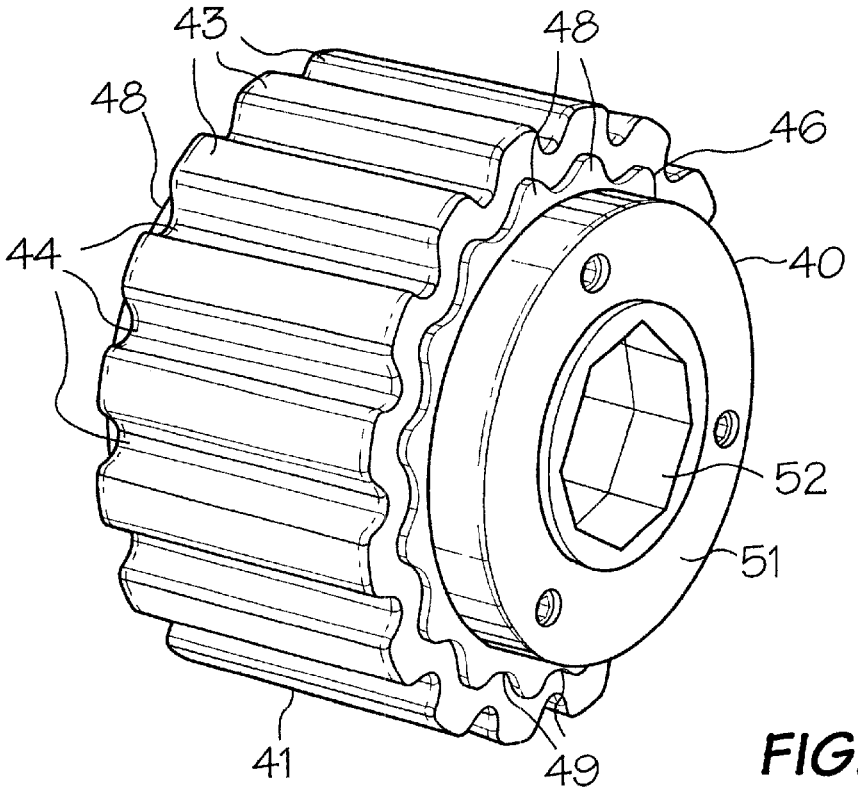
FIG. 6 is a perspective view of a top roller used in the machine of FIGS. 3 and 4.
Figure 8:
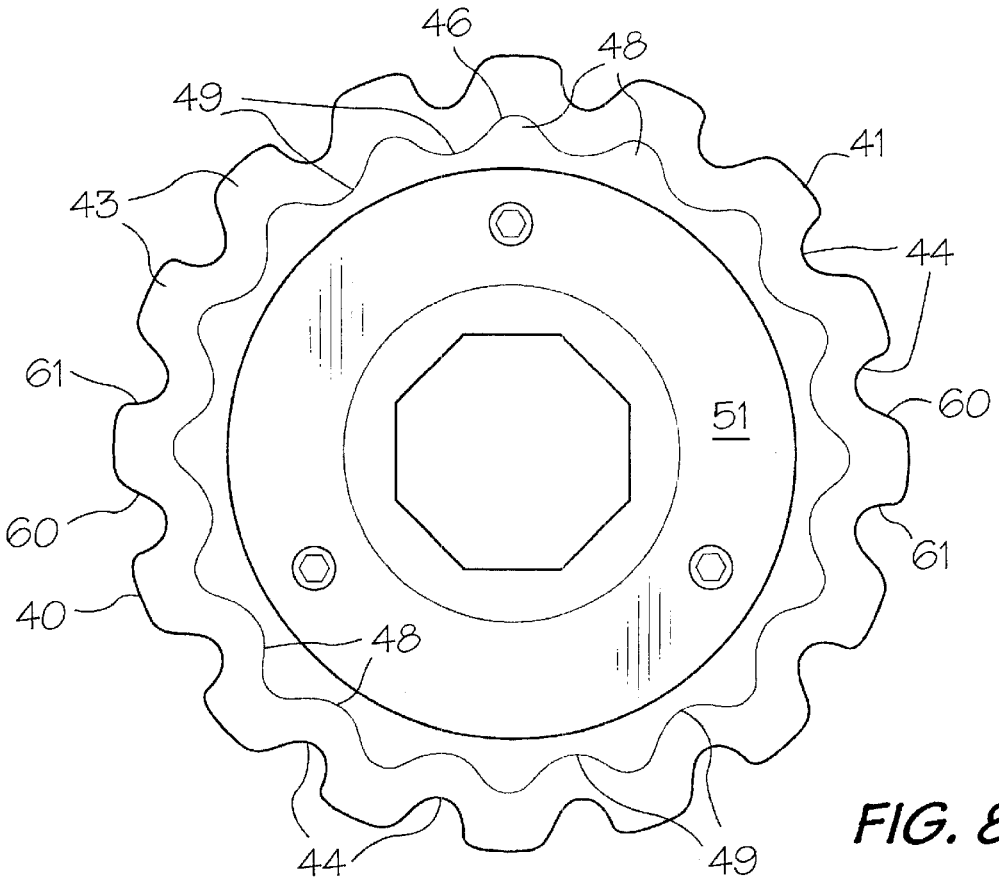
FIG. 8 is an end view of the top roller of FIG. 6.
Figure 10:
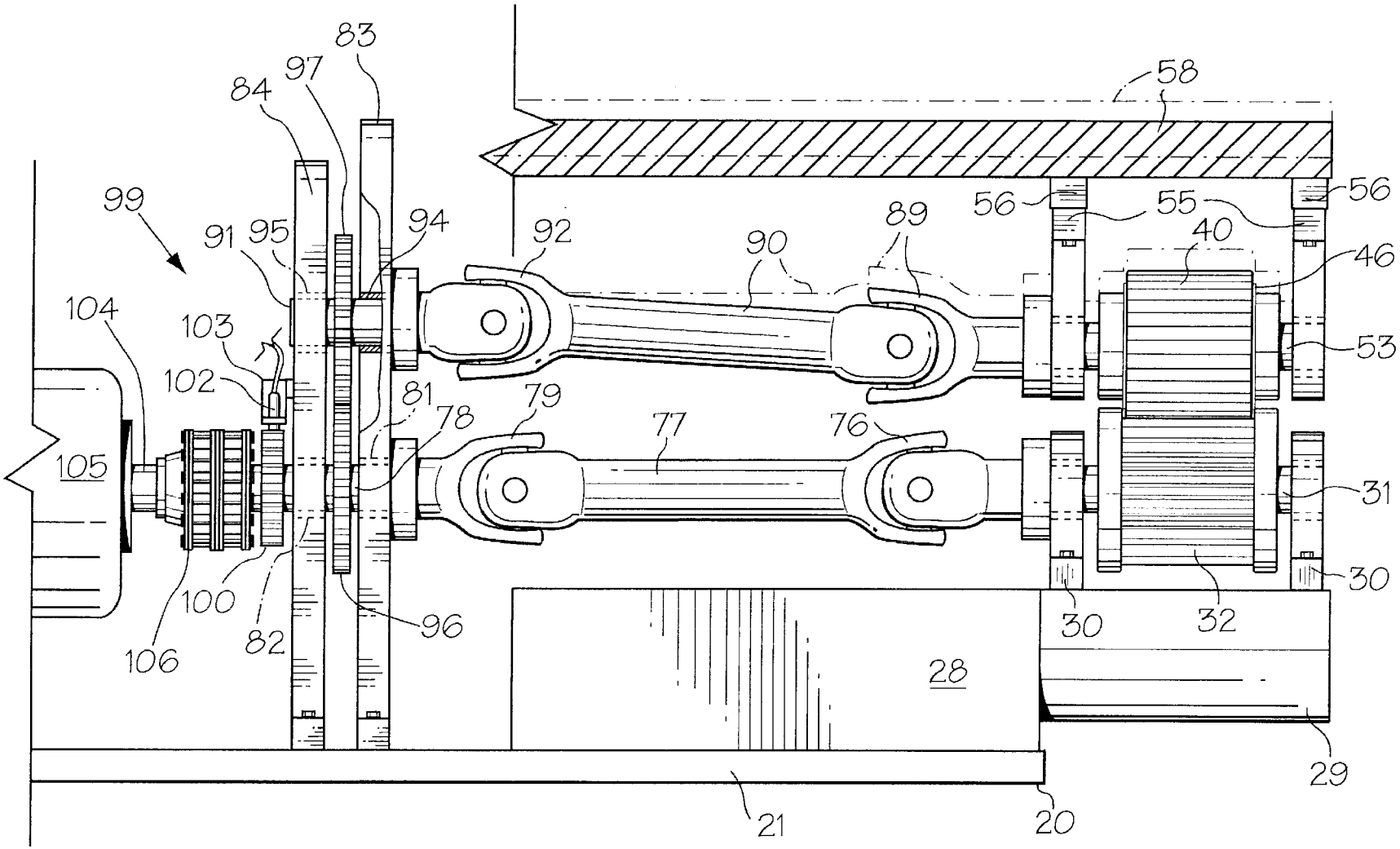
FIG. 10 is a side view of a major portion of a drive assembly used in the machine of FIGS. 3 and 4.

The bottom roller 32 is opposed by a top roller 40. Referring to FIGS. 6 and 8, the top roller 40 is defined by an elongated, generally cylindrical, corrugated body 41, i.e. a generally cylindrical body with alternating, longitudinally extending ridges 43 and grooves 44 thereon. An annular, corrugated reduced diameter portion or shoulder 46 is provided on each end of the body 41 for corrugating the flanges 4 of a blank 1. As shown in FIG. 8, the shoulders 46 include alternating ridges 48 and grooves 49 which are radially aligned with the ridges 43 and 44, respectively. During use, the corrugated body 41, including the shoulders 46, extends into the gap between the end flanges 37 of the bottom roller 32 to engage and shape the blank 1. The body 41 and hubs 51 on the ends thereof contain an octagonal cross section bore 52 for receiving a similarly shaped portion of a top shaft 53 (FIG. 10). The shaft 53 is also mounted in pillow block bearings 55 suspended from shims 56 and a movable platen 58.

As best shown in FIGS. 7 and 8, while the corrugations on the bottom roller 32 are symmetrical, the corrugations on the top roller 40 are asymmetrical . By trial and error, it has been found that if the corrugations on both rollers 32 and 40 are symmetrical, the corrugations on the spacer 2 are not uniform, i.e. they are asymmetric. During formation of a corrugated spacer, the rollers 32 and 40 are contra-rotating. The metal of the blank is deformed, and with symmetrical rollers, the resulting corrugated spacer does not contain regular corrugations. Accordingly, the ridges 43 of the top roller 40 have a leading side 60 (in the direction of rotation of the roller) which is steeper than the trailing side 61. The result is a spacer 2 with uniform corrugations.

The platen 58 is slidably mounted in the frame 8 for vertical movement between an elevated position (FIG. 3) in which the top roller 40 is spaced apart from the bottom roller 32 and a lower position (FIGS. 4 and 10) in which the top roller 40 presses downwardly against a blank 1 sandwiched between the rollers 32 and 40 to shape the blank 1. Sleeves 63 are mounted on the bottom corners of a rectangular top plate 64. The cylinders 63 are sandwiched between the top plate 64 and a lower support plate 66. Shafts 67 extending out of the cylinders 63 pass sleeves 68 in the platen 58, so that the platen 58 can slide vertically on the shafts 67. The platen 58 is moved by a piston 70 extending out of a cylinder 72 suspended from the top plate 64. Plastic blocks 73 are provided on the inner sides 74 of the posts 10, defining tracks or guides for the platen 58. The sleeves 68 have annular flanges 69 for securing the sleeves in the platen 58.

Figure 11:
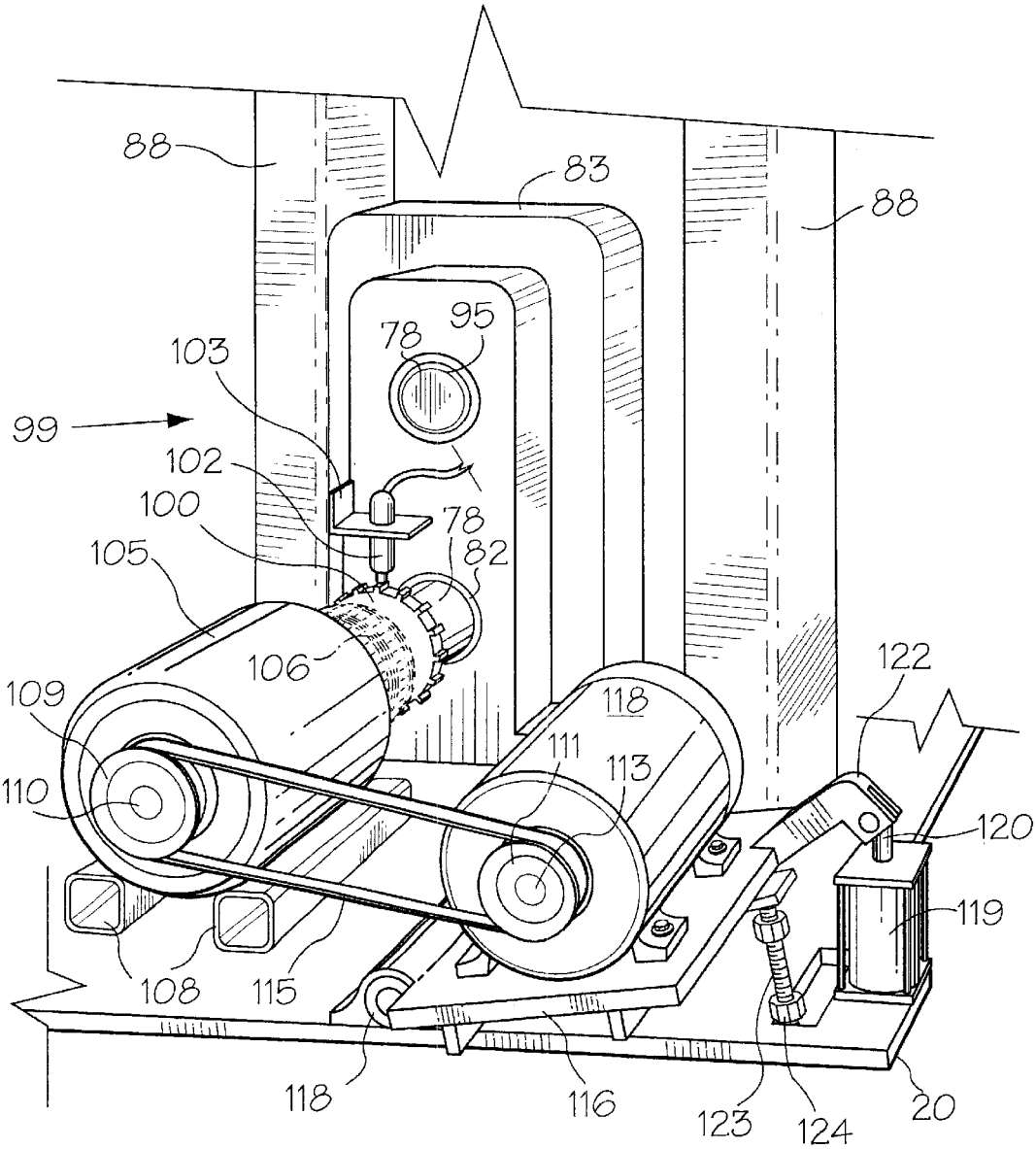
FIG. 11 is a perspective view of the rear end of the drive assembly of FIG. 10.

Referring to FIGS. 10 and 11; the shaft 31 carrying the bottom roller 32 is connected by a U-joint 76 to a large drive shaft 77 for rotating the roller 32. The shaft 77 is connected to a third shaft 78 by a second U-joint 79. The shaft 78 is rotatable in bushings 81 and 82 mounted in casings 83 and 84, respectively, which are mounted on blocks 86 and 87 on the table 20 between rear center posts 88 (FIG. 11).

Similarly, the shaft 53 carrying the top roller 40 is connected by a U-joint 89 to a large shaft 90. The shaft 90 is connected to a shaft 91 by another U-joint 92. The shaft 91 is rotatably mounted in bushings 94 and 95 in the casings 83 and 84, respectively. Meshings 96 and 97 are mounted on the shafts 78 and 91, respectively so that the shafts are rotated in unison and in opposite directions.

It will be appreciated that with the arrangements of shafts, U-joints and gears described above, the top roller 40 is driven in unison with the bottom roller 32, and the top roller 40 can be moved vertically towards and away from the bottom roller 32 as the platen 58 is moved vertically by the piston 70 and the 1n cylinder 72. As the platen 58 moves vertically, the top roller 40 moves towards or away from the bottom roller 32. Simultaneously, the front end of the shaft 90 (at the U-joint 89) moves vertically, pivoting around the horizontal axis of the U-joint 92. During operation the shafts 31 and 77 do not move vertically.

Revolutions of the shafts 31, 77 and 78, and consequently of the bottom roller 32 and the top roller 40 are counted by a counter mechanism generally indicated at 99. The counter mechanism 99 includes a toothed wheel 100 on the shaft 78 and a commercially available pushbutton counter 102 carried by a bracket 103 mounted on the casing 84. The shaft 78 is connected to a drive shaft 104 extending out of a transmission or gear box 105 by a flexible coupler 106.

As best shown in FIG. 11, the transmission 105 is mounted on bars 108 at the rear end of the table 20. A pulley 109 on a shaft 110 at the input end of the transmission 105 is connected to a pulley 111 on the drive shaft 113 of an electrical motor 114 by a belt 115. The motor 114 is mounted on an inclined plate 116 one side of which is welded to a cylindrical bearing 118 mounted on the table 20. Thus, the plate 116 can be rotated around the longitudinal axis of the bearing 118 to tension or release the tension on the belt 115. When the tension on the belt 115 is released, the belt 115 slides on the pulley 109, i.e. the shafts 78 and 104, and consequently the rollers 32 and 40 do not rotate. When tension on the belt 115 is restored, the rollers 32 and 40 start rotating.

The plate 116 carrying the motor 114 is rotated by means of a hydraulic cylinder 119, the piston rod 120 of which is connected to one edge of the plate 116 by a lever 122. Downward movement of the plate 116 to tension the belt 115 is limited by a stop in the form of a bolt 123 mounted in a nut 124 welded to the plate 116. The stop can be adjusted to change the tension on the belt 115 in the drive position by moving the bolt 123 vertically in the nut 124.

When a blank 1 or spacer 2 is between the bottom and top rollers 32 and 40, it is important that the workpiece be stabilized, i.e. remain in position between the flanges 37 of the top roller 40 without wobbling. This is achieved by means of centering assemblies generally indicated at 126.

Figure 12:
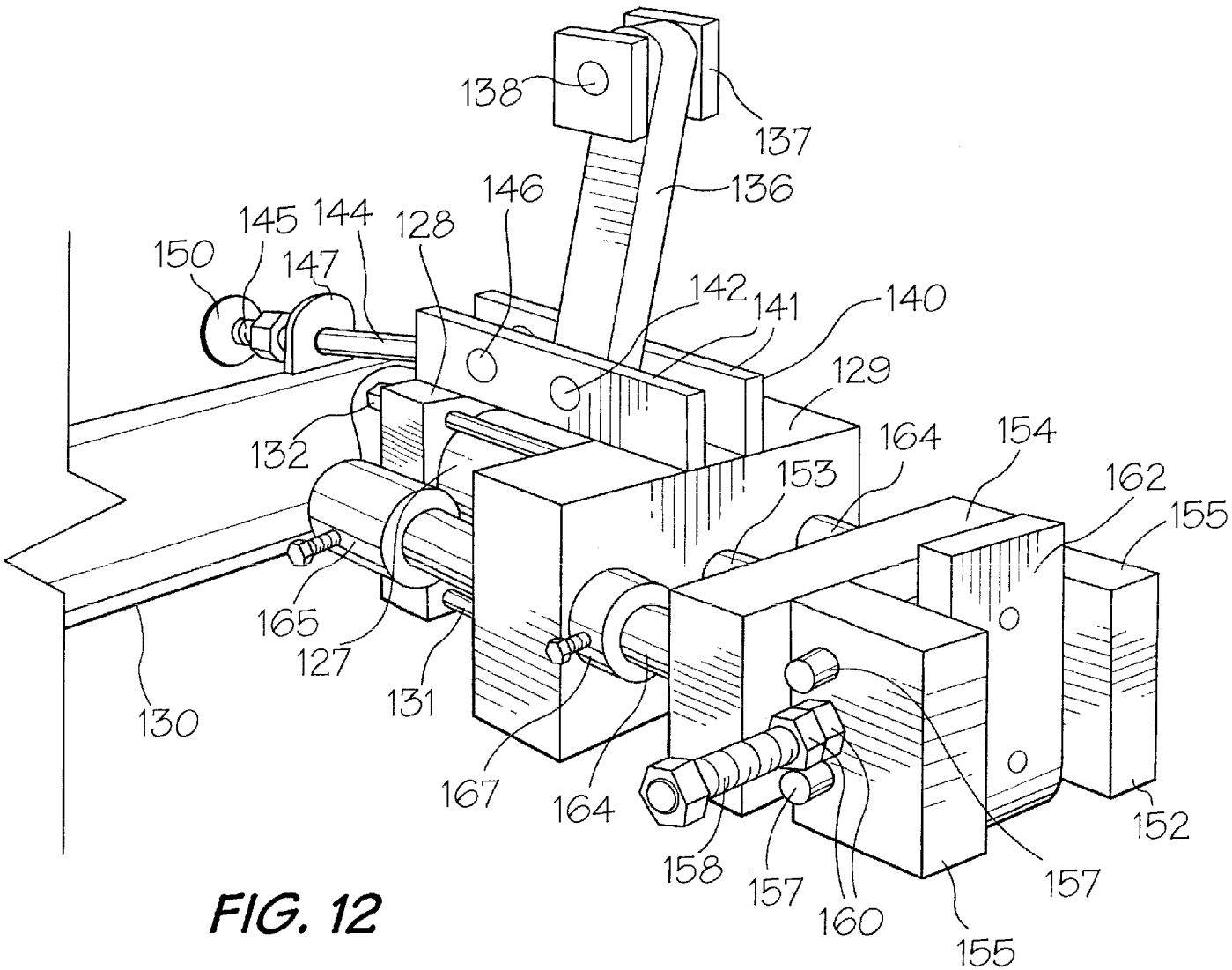
FIG. 12 is a perspective view of a guide arm assembly used in the machine of FIGS. 3 and 4.
Figure 13:
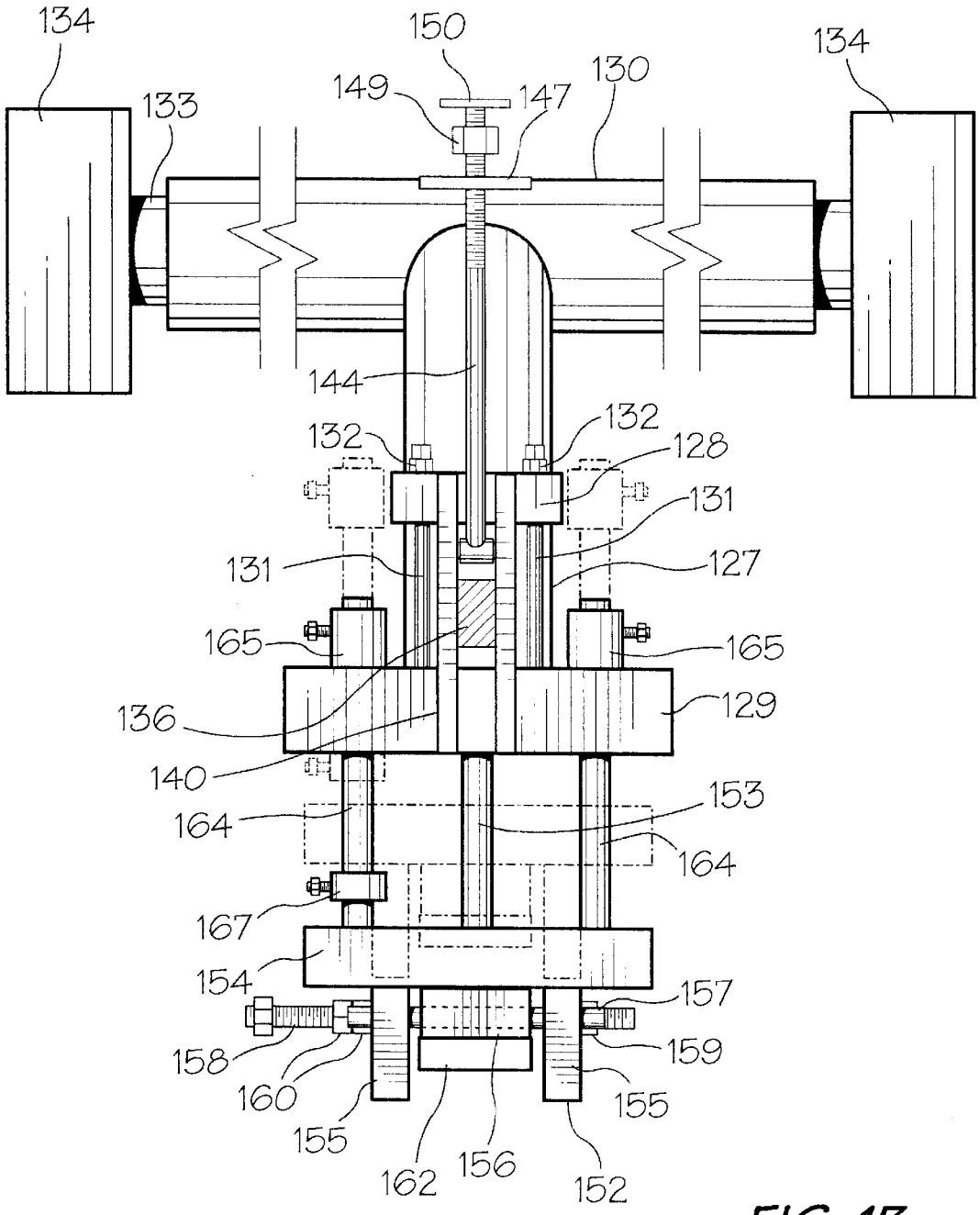
FIG. 13 is a top view of the guide arm of FIG. 12.

Referring to FIGS. 4, 12 and 13, each centering assembly 126 includes a hydraulic cylinder 127 mounted between blocks 128 and 129 on the outer end of a generally T-shaped arm 130. The blocks 128 and 129 are interconnected by rods 131 and nuts 132 on the threaded outer ends of the rods. The arm 130 is tubular, the top thereof being rotatably mounted on a shaft 133 extending between supports welded to the front post 9 and the center post 12 on each side of the frame 8. Rotation of the guide arm 130 around the longitudinal axis of the shaft 133 is controlled by movement of the platen 58, i.e. when the platen 58 moves upwardly or downwardly, the arm 130 is caused to rotate. For such purpose, a pivot arm 136 extends between the bottom of the platen 58 and the arm 130. The top end of the pivot arm 136 is pivotally connected to the platen 58 by a clevis 137 and a pin 138. The other end of the pivot arm 136 is pivotally connected to a bracket 140 defined by a pair of spaced apart plates 141 by a pin 142. The plates 141 extend between and are welded to the blocks 128 and 129.

A rod 144 with a threaded outer end 145 is pivotally mounted on a pin 146 in the bracket 1440. The threaded outer end 145 of the rod 144 extends through a to lug 147 welded to the arm 130. A nut 149 on the outer end of the rod 142 acts as a stop. Removal of the nut 147 from the rod 144 is prevented by a disc 150 welded to the outer free end of the rod. By moving the nut 147, the inclination of the pivot arm 136 is changed. Thus, the position of the centering assemblies with respect to a blank 1 or spacer 2 can be changed. A generally C-shaped jaw 152 is mounted on the outer free end of a piston rod 153 extending out of the cylinder 127 for movement toward and away from the block 129 (FIG. 13).

The jaw 152 includes a rectangular end plate 154 connected to the piston rod 153, and a pair of spaced apart sides 155. A block 156 is slidably mounted on a pair of shafts 178. A threaded rod 158 extends through the sides 155 and the block 156. Nuts 159 and 160 on the rod 157 permit adjustment of the block 156 between the sides. A plastic plate 162 is mounted on the outer end of the block 156 for bearing against the body of the blank 1 and spacer 2. Spaces between the sides 155 of the jaw, and the block 156 and plate 162 receive the flanges on the blank 1 and spacer 2.

The jaw 152 is retained in position, i.e. properly aligned with respect to the blank 1 and the spacer 2 by a pair of shafts 164 extending from the rear side of the plate 154. The shafts 164 are slidably mounted in the block 129 for movement between a retracted position (FIGS. 3 and 12) and an extended position (FIG. 3 and in phantom outline in FIG. 13) in which the jaw engages a blank 1 or spacer 2 retaining the workpiece centered on the bottom roller 32 during spacer formation. Movement of the jaw 152 with the piston rod 153 is limited by a pair of sleeves 165 on the free ends of the shafts 164 and a sleeve 167 on one of the shafts 164 between the block 129 and the end plate 154 of the jaw 152.

Figure 14:
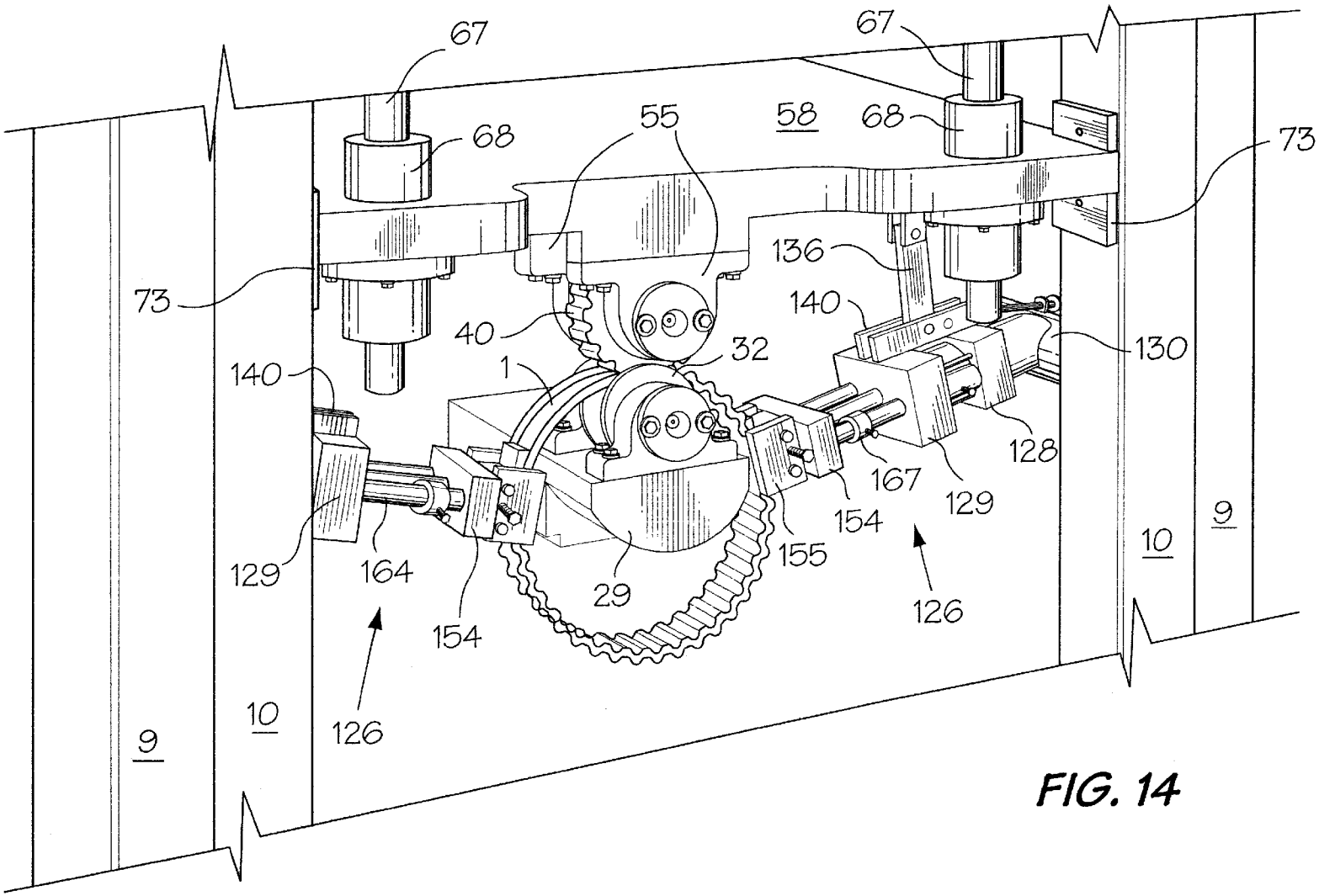
FIG. 14 is a perspective view of a portion of the front end of the machine of FIG. 1 during a spacer forming operation.

With reference to FIGS. 3 and 14, in operation, with the roller 40 in an elevated position (FIG. 3) spaced apart from the roller 32, a preformed cylindrical blank 1 is placed on the bottom roller 32 between the flanges 37. The cylinder 72 is actuated to move the platen 58 downwardly pressing the top roller 40 against the blank 1 to start shaping thereof. As the platen 58 moves downwardly, the centering assemblies 126 also move down from an elevated starting or rest position. In the lowermost position of the platen 58, the jaws 152 engage the blank 1 on each side of the top center thereof, preventing twisting of the blank as it passes between the rollers 32 and 40. Lowering of the platen 58 also results in rotation of the shaft 90 around the horizontal pivot axis of the U-joint 92 to bring the roller 40 into contact with the blank 1. The cylinder 72 maintains sufficient pressure on the platen to ensure that the rollers 32 and 40 properly shape the blank 1. With the rollers 32 and 40 rotating in opposite directions, the blank 1 is transformed into a corrugated spacer 2.

The counter 102 keeps track of the number of rotations of the rollers 32 and 40. Once the number of rotations is sufficient to form a complete spacer 2, tension on the belt 115 (FIG. 11) between the motor 114 and the transmission 105 is reduced to stop rotation of the rollers 32 and 40. At the same time, the cylinder 72 is again actuated to move the platen 58 upwardly, releasing the spacer 2 for manual removal from the machine. A new blank 1 is placed on the bottom roller 32 and the process repeated.

We claim:

1. A machine for producing a corrugated wheel spacer from an annular spacer blank comprising:

(a) a skeletal frame, (b) a table fixed in said frame;

(c) a first corrugated roller on said table for receiving an annular spacer blank;

(d) a platen slidable in said frame above said table for vertical movement toward and away from said table;

(e) a second corrugated roller suspended from said platen above said first roller for vertical movement with said platen;

(f) a first fluid actuated cylinder on said frame for moving the platen and said second roller vertically between a first, elevated position above and spaced apart from said first roller permitting mounting of a spacer blank on the first roller, and a second, lower position in which the second roller is proximate the first roller for sandwiching a spacer blank between the first and second rollers, and wherein said platen and first cylinder press said second roller against a spacer blank;

(g) a pair of stabilizers rotatable on said frame and connected to said platen for movement with the platen into engagement with opposite sides of a spacer blank when the platen is moved from said elevated to said lower position for centering a spacer blank on the first roller, and for releasing a finished spacer when the platen is returned to the first position;

(h) teeth on each said first and second roller for meshing during rotation of said rollers to form corrugations on a spacer blank sandwiched therebetween; and (i) a drive for simultaneously counter-rotating said first and second rollers, whereby corrugations can be formed on a spacer blank sandwiched therebetween.

2. The machine of claim 1, wherein said drive includes a first shaft carrying said first roller, a second shaft carrying said second roller, a motor for rotating one of said first and second shafts, and gears interconnecting said first and second shafts for causing simultaneous rotation of said first and second shafts when said motor is actuated.

3. The machine of claim 2, including a counter mechanism associated with said first shaft for counting the number of rotations of said first shaft, whereby rotation of said first and second shafts continues until the entire annular spacer blank has been completed.

4. The machine of claim 3, wherein said counter mechanism includes a toothed wheel on said first shaft, and a push button counter on said frame for actuation by said toothed wheel during rotation of said toothed wheel.

5. The machine of claim 1, wherein each said stabilizer includes a first arm having first and second ends, said first end being pivotally connected to said frame; and a jaw on second end of said first arm for retaining a spacer blank and a spacer produced therefrom centered on said first roller.

6. The machine of claim 5, wherein each said stabilizer includes a second arm pivotally connecting said first arm to said platen, whereby said jaw can be moved into engagement with said blank simultaneously with movement of said second roller into said second position.

7. The machine of claim 1, wherein said first roller includes a first cylindrical body, first longitudinally extending corrugations on said first body, and annular flanges on the ends of said body for overlapping said second roller and for retaining a spacer blank or spacer thereon; and said second roller includes a second cylindrical body, and second longitudinally extending corrugations on said second body.

8. The machine of claim 7, wherein said second roller includes annular, corrugated shoulders on each end thereof, whereby the machine can form corrugated flanges on an annular blank having annular flanges on each end thereof.

9. The machine of claim 7, wherein said first corrugations on said first roller are symmetrical, and said second corrugations on said second roller are asymmetrical, each said second corrugation including a leading side and a trailing side in the direction of second roller rotation, said leading side being steeper than said trailing side of the second roller for forming regular corrugations.

* * * * *